US008888309B1

(12) United States Patent
Foo et al.

(10) Patent No.: US 8,888,309 B1
(45) Date of Patent: Nov. 18, 2014

(54) LIGHTED ELECTRONIC DEVICE CASES

(75) Inventors: Khim Hung Foo, Cupertino, CA (US); Kari J. Rinko, Helsinki (FI); John Gee Tang, Redwood City, CA (US); Gregory T. Witmer, Portola Valley, CA (US); Qing-Hua He, Guangdong (CN); Jerilynn S. Ng, Sunnyvale, CA (US)

(73) Assignee: Amazon Technologies, Inc., Reno, NV (US)

( * ) Notice: Subject to any disclaimer, the term of this patent is extended or adjusted under 35 U.S.C. 154(b) by 164 days.

(21) Appl. No.: 13/246,699

(22) Filed: Sep. 27, 2011

(51) Int. Cl.
*A47B 19/00* (2006.01)

(52) U.S. Cl.
USPC ..... 362/98; 362/99; 362/154; 362/155; 362/253

(58) Field of Classification Search
USPC ..... 362/98–99, 154–155, 253, 458
See application file for complete search history.

(56) References Cited

U.S. PATENT DOCUMENTS

| | | | | |
|---|---|---|---|---|
| 5,583,742 | A * | 12/1996 | Noda et al. | 361/679.21 |
| 6,844,845 | B1 * | 1/2005 | Whiteside et al. | 342/357.64 |
| 7,158,376 | B2 * | 1/2007 | Richardson et al. | 361/679.56 |
| 8,220,945 | B2 * | 7/2012 | Huang et al. | 362/98 |
| 8,246,208 | B2 * | 8/2012 | Huang et al. | 362/253 |
| 8,256,937 | B2 * | 9/2012 | Bleyle et al. | 362/427 |
| 8,348,450 | B2 * | 1/2013 | Hebenstreit et al. | 362/109 |
| 2003/0198040 | A1 * | 10/2003 | Chen et al. | 362/84 |
| 2009/0159478 | A1 * | 6/2009 | Pfanstiehl | 206/449 |
| 2010/0149796 | A1 * | 6/2010 | Mish et al. | 362/190 |
| 2011/0051436 | A1 * | 3/2011 | Bleyele et al. | 362/427 |
| 2013/0063004 | A1 * | 3/2013 | Lai et al. | 312/223.1 |

* cited by examiner

*Primary Examiner* — Thomas M Sember
*Assistant Examiner* — Tsion Tumebo
(74) *Attorney, Agent, or Firm* — Lee & Hayes, PLLC

(57) ABSTRACT

An electronic device case comprises a housing having a pivotable light arm and a receptacle. The light arm may be displaced between a stowed position and a use position. When in the use position, the light arm reduces the amount of glare light and increases the uniformity of light distribution to effectively illuminate the display of the electronic device. The receptacle comprises a lip over-molded to a base. The lip may be formed of a material that is more flexible than a material forming the base.

22 Claims, 6 Drawing Sheets

LIGHTED ELECTRONIC DEVICE CASES

BACKGROUND

Many different types of cases house electronic devices, such as cellular phones, tablet computing devices, electronic book readers, and the like. Some of these cases included integrated light systems that function to shine light from different locations of the housing in an attempt to effectively illuminate the electronic devices housed by the case. For example, cases may have an integrated light system located at a corner of the case to generally shine light from one corner to another corner of the electronic device. Further, cases may have an integrated lighting system located at a spine of the case to generally shine light from directly above the electronic device.

While these approaches may illuminate electronic devices housed by the case, in some instances they are very coarse and do not provide effective lighting. For example, an integrated light illuminating an electronic device may generally illuminate a display of the electronic device but may also produce a disturbing glare to a reader's eye. For example, the integrated light may shine light from such a high location that the resulting angle at which the light is incident on the surface of the display results in a large amount of disturbing glare. Further, the integrated light may not illuminate a display of an electronic device uniformly. For example, the integrated light may shine light from such a low location that the resulting angle at which the light is incident on the surface of the display results in one brightly lit portion and other dimly lit portions. The afore-mentioned glare on a display of an electronic device coupled with a lack of uniformity in the illumination of the display may negatively affect the enjoyment of a user attempting to view content on the device.

BRIEF DESCRIPTION OF THE DRAWINGS

The detailed description is described with reference to the accompanying figures. The use of the same reference numbers in different figures indicates similar or identical items.

DETAILED DESCRIPTION

Overview

Figure 1:
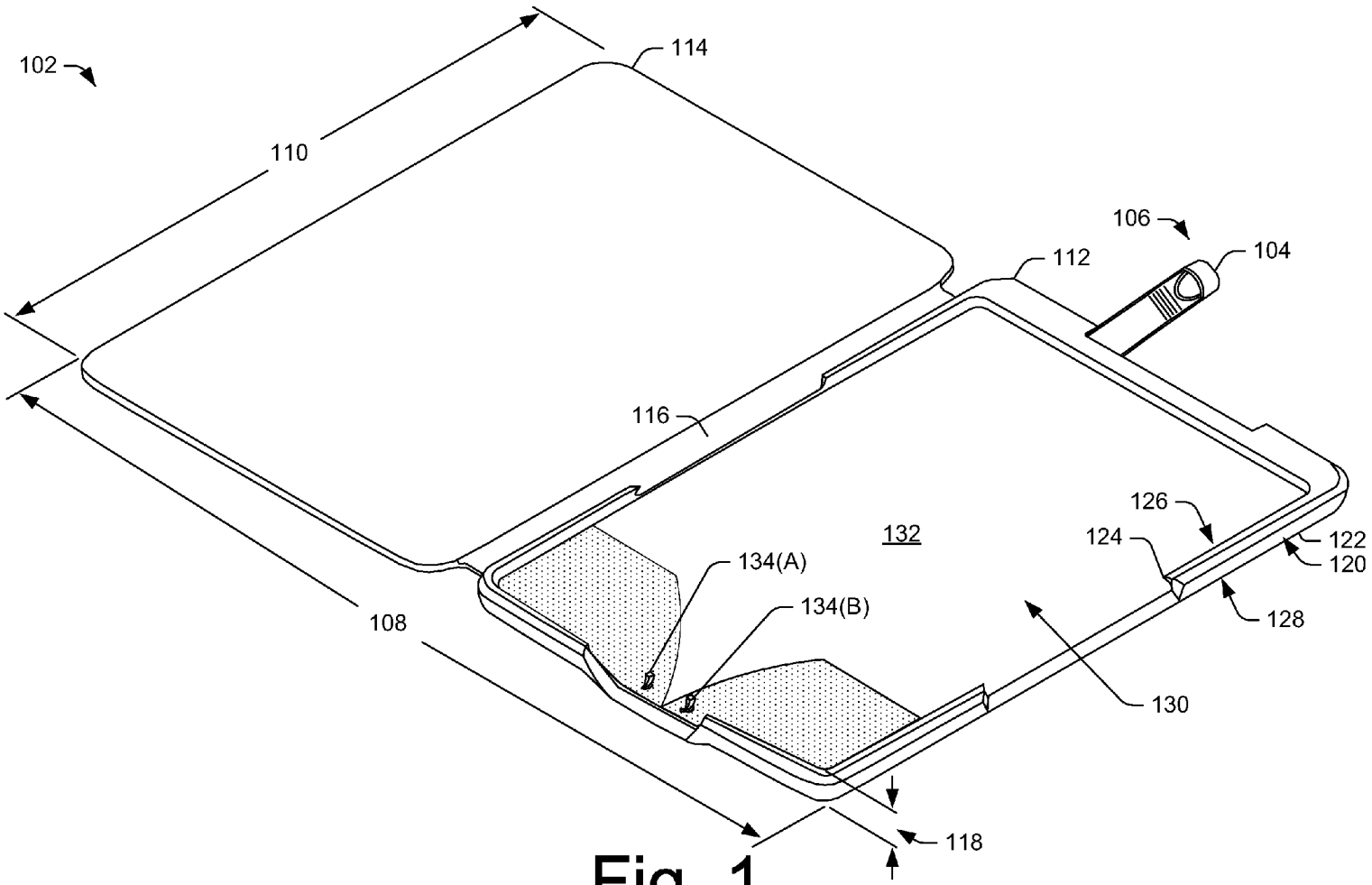
FIG. 1 illustrates an example case for holding an electronic device, with the case including a light arm pivotably attached to the case in a use position.

This disclosure is directed to, in part, cases for holding electronic devices having an integrated light arm pivotably attached to the case. In one embodiment, the case may comprise a housing and a light arm pivotably attached to the housing. The light arm may be displaced between a stowed position and a use position. For example, the light arm may be displaced at least about 30 degrees to at most about 90 degrees from the stowed position to the use position. Further, the light arm may be displaced at least about 45 degrees to at most about 51 degrees (e.g., 48 degrees) in some implementations. In the use position, the light arm may efficiently and evenly illuminate an electronic device contained by the case. The light arm may comprise a light (e.g., a light-emitting diode (LED)) recessed behind a visor. The light arm may be arranged to prevent emitted light from shining from the light into a user's eye. In the stowed position, the light arm may be received and guarded by a recess until a time of use.

In another embodiment, the case may comprise a housing having a receptacle to removably receive an electronic device. The receptacle may comprise a lip formed of a flexible material that is over-molded or co-molded together with a base. The base may be formed of another material which may be less flexible than the flexible material forming the lip. By way of example and not limitation, the lip may be a beveled edge, an arris, a chamfer, or any other feature suitable to retain the electronic device in the receptacle. The lip may deform or displace as a result of insertion of an electronic device into the receptacle. For example, the lip may deform or displace towards an inside and/or an outside of the housing as the electronic device interferes with the lip. As such, the lip may deform or displace to provide for an electronic device to slip past the lip and into the housing. Further, the lip may deform or displace as a result of removal of an electronic device out of the receptacle. For example, the lip may deform or displace away from an inside and/or an outside of the housing as the electronic device interferes with the lip. As such, the lip may deform or displace to provide for an electronic device to slip past the lip and out of the housing Subsequent to receiving the electronic device, the lip may return to its original non-deformed state. In this way, the lip may retain the electronic device in the housing.

In another embodiment, the case may comprise a recess arranged in a top outside wall of the housing. The recess may comprise a cooperating pocket to receive and pivotably couple with an end of the light arm. Together, the cooperating pocket and the light arm may provide for selectively pivoting the light arm between a stowed position and a use position.

Because the cases described herein include light arms that may be selectively displaced to an optimized use position, these cases effectively illuminate displays of electronic devices contained within or otherwise coupled to the cases. For example, when the light arm is in the use position, the light arm reduces the amount of glare light and increases the uniformity of light distribution to effectively illuminate the displays of the electronic devices. In this way, the cases having the pivotably attached light arm may increase a user's viewing experience. Further, because the light arms of the cases are pivotably displaced to a stowed position, these cases may significantly reduce the potential of damaging the light arms when the light arms are not in use. For example, when a cover of the case is closed onto a light arm in a use position, the cover may pivotably displace the light arm down into the stowed position rather over extending the light arm in the use position.

While the illustrated embodiments show the electronic device as an electronic book reader device, the cases described herein may function with any type of electronic device. For example, these cases may couple to mobile devices, handheld computers, smartphones, personal digital assistants, media players, tablet computer, laptop computers, or other electronic devices.

Example Electronic Device Cases

FIG. 1 illustrates an example case 102 including a light arm 104 pivotably attached to another portion of the case 102 in a use position 106. The light arm 104 may be configured to shine light when in the use position 106 while refraining from shining light when in a stowed position. For example, the light arm 104 may receive power and, hence, illuminate a display of an electronic device housed in the case 102 in response to the light being displaced into the use position 106. To illustrate, the light arm 104 may be configured as a switch, such that when the light arm 104 is displaced into the use position 106 the light arm 104 is turned on and shines light on the display.

In one example, the case 102 may have a length 108 of about 250 millimeters (10 inches) and a width 110 of about 180 millimeters (7 inches). The case 102 may comprise a housing 112 and a cover 114, which may pivotably attach to the housing 112 and may cover an electronic device contained in the housing 112. The cover 114 may be formed of plastic, fabric, composite, or any other material. For example, the cover 114 may be formed of layer(s) of microfiber, layer(s) of adhesive, layer(s) of fiberboard (e.g., cardboard), and/or layer (s) of fabric. While FIG. 1 illustrates the cover 114 pivotably attached to the housing 112 via a hinge 116 formed of layers of a fabric composite (e.g., layers of fabric, layers of microfibers, and layers of adhesive), the cover 114 may be pivotably attached to the housing 112 via a living hinge, a barrel hinge, a strap hinge, etc. In still other embodiments, the case 102 may omit the cover 114.

The housing 112, meanwhile, may also be formed of plastic, fabric, composite, or any other material. For example, the housing 112 may be formed of layer(s) of microfiber, layer(s) of adhesive, layer(s) of plastic, layer(s) of fabric, and/or any other type of material of combination of materials. Further, in some specific instances the housing may be formed of thermoplastic polyurethane (TPU), thermoplastic rubber (TPR), rubber, thermoplastic elastomers (TPE), polycarbonate acrylonitrile butadiene styrene (PC/ABS), polycarbonate, polypropylene (PP), acrylonitrile butadiene styrene (ABS), Polyoxymethylene (POM)), and/or the like.

The housing 112 may comprise a height 118 of about 13 millimeters (0.5 inches) and may include a wall 120 arranged around a perimeter 122 of the housing 112. The wall 120 may represent a single structure (e.g., a single molded element) or may represent multiple layers adjacent to one another. The wall 120 may comprise a lip 124 arranged around an inside 126 of the wall 120 opposite an outside 128 of the wall 120. The lip 124 arranged on the inside 126 of the wall 120 may define a receptacle 130 to removably receive an electronic device. The lip 124 may be fixed above a base 132, which may define a bottom or floor of the receptacle 130. For example, the lip 124 may be over-molded, co-molded, friction welded, adhered, or otherwise attached to a top side of the base 132. The lip 124 may be any feature suitable to retain an electronic device in the receptacle 130. For example, the lip 124 may be a beveled edge, an arris, a chamfer, beads, ribs, or any other structural element arranged around the inside 126 of the wall 120 to retain an electronic device in the receptacle 130.

The lip 124 may be formed of a material more flexible than another material forming the base 132 in some instances. For example, the lip 124 may be formed of thermoplastic polyurethane (TPU), thermoplastic rubber (TPR), rubber, thermoplastic elastomers (TPE), fabric mesh, or any other suitable material. The base 132, meanwhile, may be formed of a polycarbonate acrylonitrile butadiene styrene (PC/ABS), polycarbonate, polypropylene (PP), acrylonitrile butadiene styrene (ABS), Polyoxymethylene (POM)) or any other suitable material.

The housing 112 may comprise cooperating terminals 134 (A) and 134(B) disposed in the base 132. Cooperating terminals 134(A) and 134(B) may provide for electrically connecting with cooperating terminals of an electronic device housed by the housing 112. For example, cooperating terminals 134 (A) and 134(B) may electrically connect with the cooperating terminals of the electronic device when the electronic device is received by the receptacle 130. The cooperating terminals 134(A) and 134(B) may be leaf spring connectors, buttons, ramps, bumps, or the like suitable for interfacing with cooperating terminals of the electronic device. A portion of the cooperating terminals 134(A) and 134(B) may be encapsulated by a cavity disposed in the base 132 of the housing 112. Another portion of the cooperating terminals 134(A) and 134(B) may protrude from the base 132 to interface with the cooperating terminals of an electronic device.

In addition, the cooperating terminals 134(A) and 134(B) may electrically interconnect with the light arm 104. For example, subsequent to the cooperating terminals 134(A) and 134(B) electrically interfacing with the electronic device, the cooperating terminals 134(A) and 134(B) may receive power from the electronic device housed by the housing 112 and then provide this power to the light arm 104. For example, the case 102 may receive power from an electronic device contained by the case 102. While the illustrated embodiments show a case 102 having no battery, the case 102 may comprise a battery, an outlet power cord, or other component for providing power to the light arm 104 and/or a device housed within the case 102. For example, the case 102 may comprise a battery and/or an outlet power cord to power a light of the light arm 104, potentially along with a device housed within the case 102 via the cooperating terminals of the case and corresponding terminals of the device.

Figure 2:
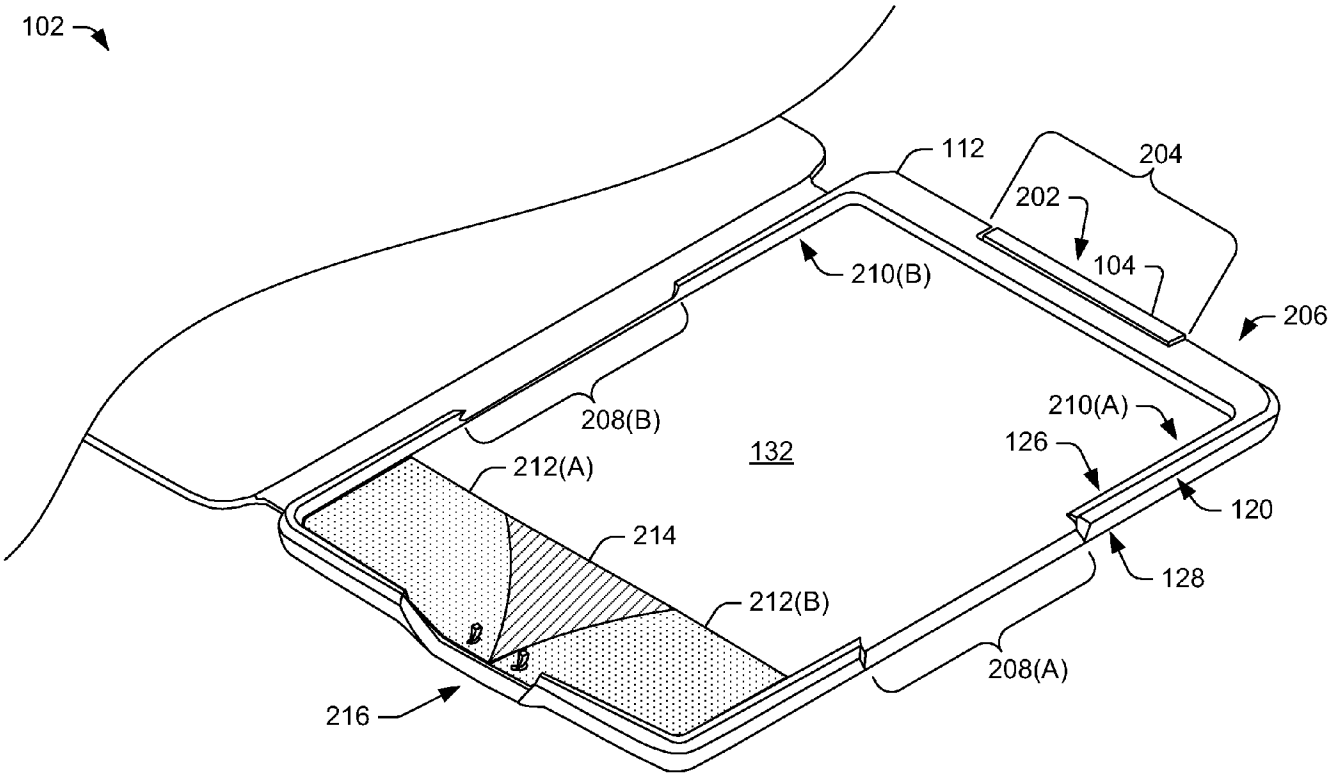
FIG. 2 illustrates the case of FIG. 1 with the light arm in a stowed position.

FIG. 2 illustrates the case 102 of FIG. 1 with the light arm 104 in a stowed position 202. The housing 112 may comprise a recess 204 arranged in a top portion 206 of the housing 112. The recess 204 may be arranged in the outside 128 of the wall 120 opposite the lip 124. As FIG. 2 illustrates, the recess 204 may receive the light arm 104 when the light arm 104 is in a stowed position 202. The housing 112 may comprise side cutouts 208(A) and 208(B) arranged in the sides 210(A) and 210(B) of the housing 112, respectively. The side cutouts 208(A) and 208(B) may provide access to one or more buttons of an electronic device contained in the housing 112. While FIG. 2 illustrates two example cutouts, it is to be appreciated that the other embodiments may include more or fewer cutouts located at different locations of the case 102.

In addition, the housing 112 may comprise cavities 212(A) and 212(B) arranged in the base 132. The cavities 212(A) and 212(B) may be recessed in the base 132. The cavities 212(A) and 212(B) may provide a passage way for sound produced by one or more electroacoustic transducers (e.g., low fidelity speakers, high fidelity speakers, piezoelectric speakers, etc.) of an electronic device contained in the housing 112. A ridge 214 may be arranged between the cavities 212(A) and 212 (B). In combination with the cavities 212(A) and 212(B) and a bottom cutout 216, the ridge 214 may keep separate the sounds produced by speakers of the electronic device removably received in the housing 112. That is, sound emitted from respective speakers of an electronic device that reside atop the cavities 212(A) and 212(B) when secured in the case 102 may pass from the respective cavities and out of the bottom cutout 216, with the ridge 214 functioning to prevent mixing of this sound. Again, while FIG. 1 illustrates example cavities, it is to be appreciated that the other embodiments may include more or fewer cavities located at different locations of the case 102.

While FIGS. 1 and 2 illustrate a case 102 having a generally rectangular cross-sectional shape, the case 102 may be any shape suitable shape for containing electronic devices. For example, the case 102 may be circular, octagonal, square, or the like. Further, while FIG. 2 illustrates a light arm 104 utilizing a recess 204, the light arm 104 may stow without use of a recess in some implementations. For example, the light arm 104 may mount directly to the top of the housing, protruding from the housing when in the stowed position.

Figure 3:
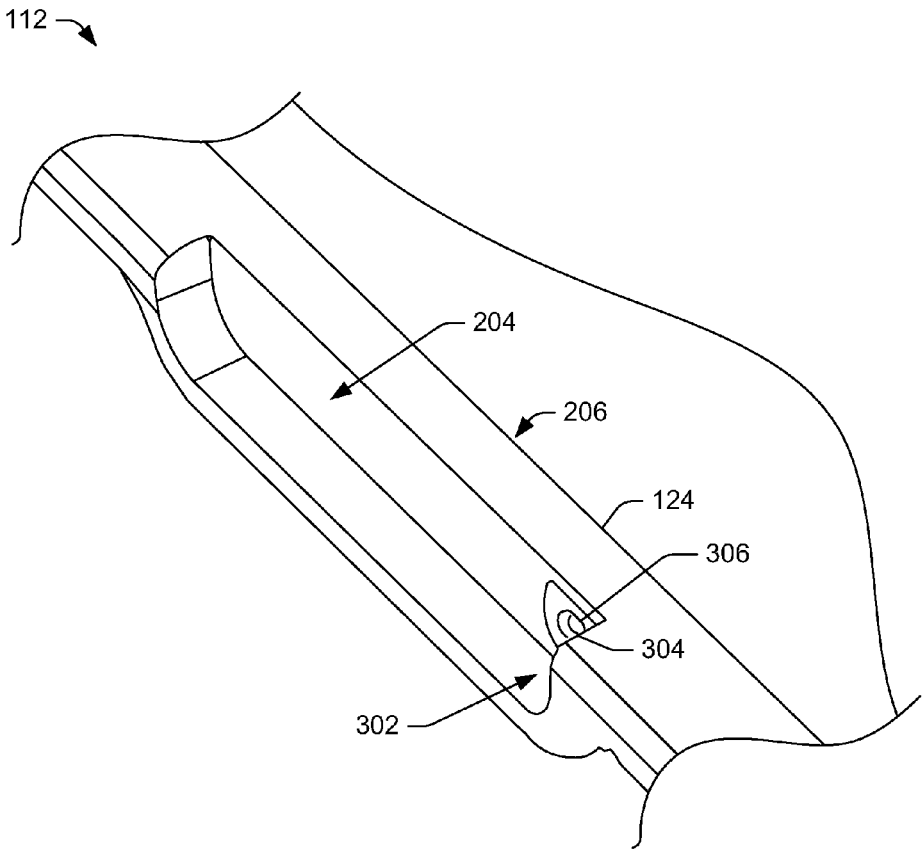
FIG. 3 illustrates the recess of the case of FIG. 2.

FIG. 3 illustrates the recess 204 of the housing 112 of FIG. 2. The recess 204 may comprise a cooperating pocket 302 that pivotably couples with an end of the light arm 104. For example, the cooperating pocket 302 may receive an end of the light arm 104 comprising a fulcrum. The cooperating pocket 302 may also include a stop surface 304 to prevent the light arm 104 from being pivoted past the use position 106. The cooperating pocket 302 may also comprise a socket 306. The socket 306 may pivotably couple with a fulcrum of the light arm 104. The recess 204 may receive substantially the entire light arm 104 when the light arm 104 is in the stowed position. For example, the recess 204 may receive the light arm 104 such that the light arm 114 is flush with adjacent surfaces of the cover and, hence, such that surfaces of the light arm 104 do not protrude from the recess 204 when in the stowed position.

Figure 4:
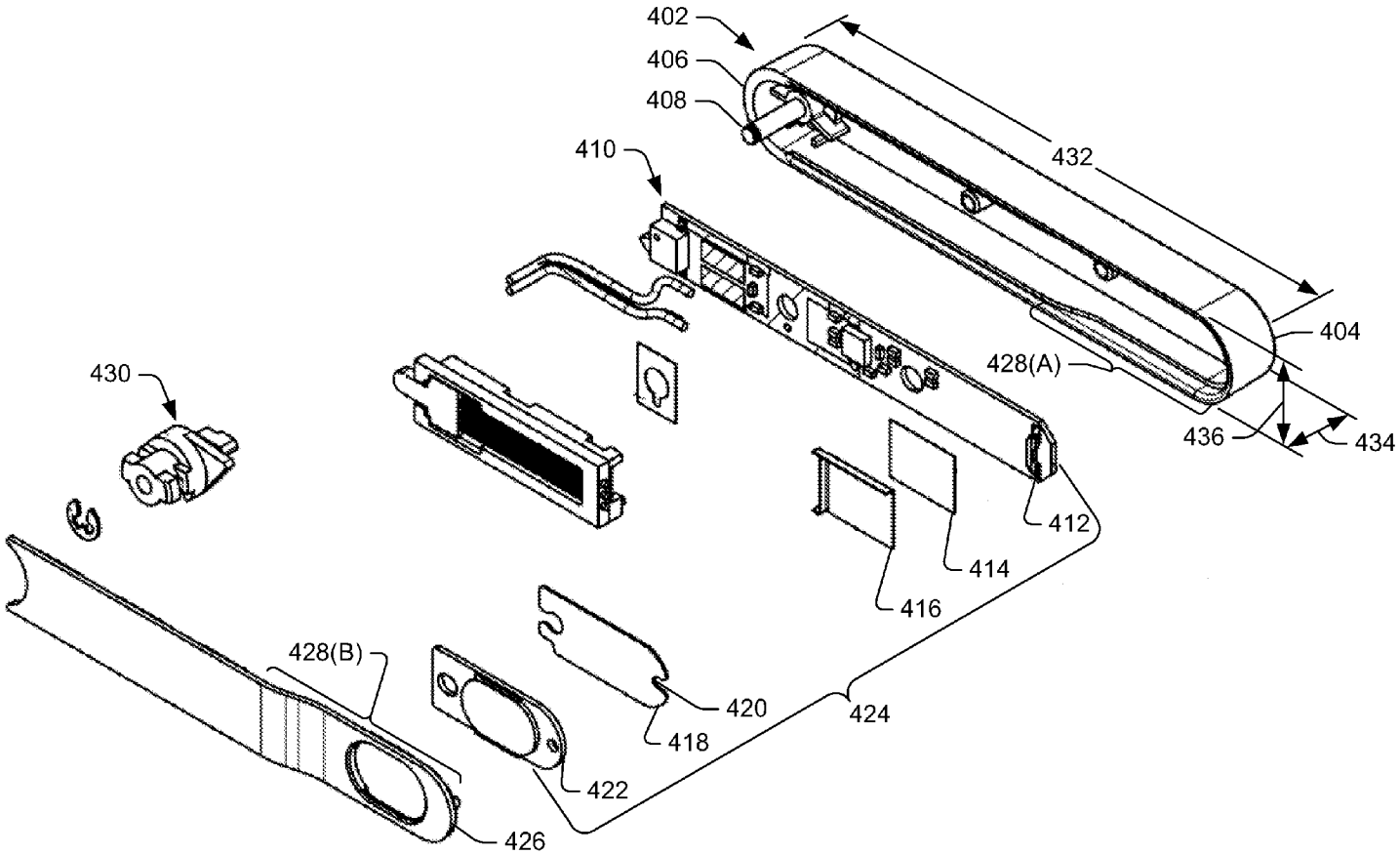
FIG. 4 illustrates an exploded assembly view of the light arm of the case of FIGS. 1 and 2.

FIG. 4 illustrates an exploded assembly view of the light arm 104 of the case 102 of FIGS. 1 and 2. The light arm 104 may comprise an outer housing 402 having a first end 404 opposite a second end 406. A fulcrum 408 may be disposed in the second end 406 of the outer housing 402. The outer housing 402 may receive a printed circuit board assembly (PCBA) 410. The PCBA 410 may comprise a light-emitting diode (LED) 412 disposed on an end of the PCBA 410. While FIG. 4 illustrates one LED 412 disposed on the PCBA 410, a plurality of LEDs may be disposed on the end of the PCBA 410. For example, two, three, four, etc. LEDs may be disposed on the end of the PCBA 410. The outer housing 402 may receive the PCBA 410 such that the LED 412 is disposed in the outer housing 402 distal to the fulcrum 408. For example, the outer housing 402 may receive the PCBA 410 such that the LED 412 is disposed in the first end 404 opposite the second end 406.

The PCBA 410 may also receive a reflector adhesive 414. The reflector adhesive 414 may in turn receive a reflector 416. A lens 418 may rest proximate to the reflector 416. The lens 418 may be substantially planar and comprise a generally round, oval, rectangular, square, etc., shape. The lens 418 may be formed of an optically clear polymeric material, elastomeric material, ceramic material, glass, or the like. For example, the lens 418 may be formed of a polyethylene terephthalate (PET), a poly(methyl methacrylate) (PMMA), polycarbonate (PC), or other polymers. The material may be clear ultraviolet (UV) or thermal cured.

The lens 418 may comprise a plurality of discrete fine optic surface relief structures on at least one portion of at least one surface of the lens (discussed in detail with respect to FIG. 6 below). The lens 418 may be positioned on the PCBA 410 such that it receives light injected by the LED 412. For example, the lens 418 may receive light from the LED 412 at an edge 420 of the lens 418. Further, the lens 418 may be positioned proximate to the PCBA 410 with respect to the LED 412 such that the LED 412 illuminates a surface of the lens 418. The surface of the lens 418 may comprise an optical surface relief structure to outcouple light from the lens 418. For example, the LED 412 may reside between the PCBA 410 and the lens 418, and LED 412 may inject light into the optical surface relief structure of the lens 418, which in turn may diffract the light towards the housing of the case 102 (i.e., towards a portion of the case that may house a display of an electronic device). A window 422 may be positioned on the lens 418. The window 422 may be flat and in compression with the lens 418, and may act as a diffuser. For example, the window 422 may soften or reduce bright spots (e.g., hot spots) produced by the LED 412. Further, the PCBA 410, LED 412, reflector 416, lens 418, and window 422 may comprise any shape suitable for being assembled into a low-profile assembly to be housed in the light arm 104. For example, the PCBA 410, LED 412, reflector 416, lens 418, and window 422 may be generally curved (e.g., semicircular, circular, annulus, etc.) or polygonal in shape.

The LED 412, reflector adhesive 414, reflector 416, lens 418, and/or window 422 may be assembled in the first end 404 of outer housing 402. The assembly comprising the LED 412, reflector adhesive 414, reflector 416, lens 418, and/or window 422 may define a light 424. The light 424 may be disposed in the first end 404 opposite the second end 406. Further, the light 424 may be disposed distal to the fulcrum 408. An inner housing 426 may encapsulate the light 424 in the first end 404 of the outer housing 402. The outer housing 402 may comprise a recess 428(A) that may receive a cooperating portion 428(B) of the inner housing 426. The recess 428(A) may comprise a depth of at least about 1 millimeter (0.04 inches) to at most about 1.5 millimeters (0.06 inches). The recess 428(A) defining a visor arranged in the light arm 104. For example, because the light 424 is disposed in the recess 428 (A), the recess 428(A) may direct light emitted by the light 424 towards an electronic device contained in the case 102 instead of into a reader's eye. Further, because the recess 428(A) may comprise a depth of at least about 1 millimeter to at most about 1.5 millimeters, the light 424 is recessed behind a visor of material of the outer housing 402. For example, the visor of the outer housing 402 may comprise the depth of at least about 1 millimeter to at most about 1.5 millimeters as a result of the depth of the recess 428(A). The outer housing 402, inner housing 426, lens 418, and window 422 may be formed of a plastic in some instances. For example, the outer housing 402, inner housing 426, and window 422 may be formed of a polycarbonate resin thermoplastic and the lens may be formed of a translucent white polyethylene terephthalate.

A cam 430 may couple with the fulcrum 408. The cam 430 may provide for selectively displacement of the light arm 104 from the stowed position 202 to the use position 106. The cam 430 may also provide for removably locking and/or unlocking the light arm 104 into and/or out of the use position 106. For example, the cam 430 may allow a user to pivot the light arm 104 into the use position 106 where it is removably locked by the cam 430. A user may then close the cover 114, and when the cover 114 comes into contact with the light arm 104 with a predetermined amount of force, the cam 430 may removably unlock and allow the light arm 104 to be displaced back down into the stowed position 202 as a result of the contact, without damaging the light arm 104.

As illustrated, the light arm 104 may comprise a length 432, a width 434, and a height 436. In one embodiment, the length 432 may be at least about 57 millimeters (2 inches) to a most about 64 millimeters (2.5 inches). The width 434 may be at least about 5 millimeters (0.2 inches) to a most about 10 millimeters (0.4 inches). The height 436 may be at least about 5 millimeters (0.2 inches) to a most about 10 millimeters (2.5 inches). While the light arm 104 is illustrated in FIG. 4 as comprising a generally rectangular shape, the light arm 104 may be any other shape suitable for being pivoted and housing a light. For example, the light arm 104 may be triangular, tubular, planar, etc.

Figure 5:
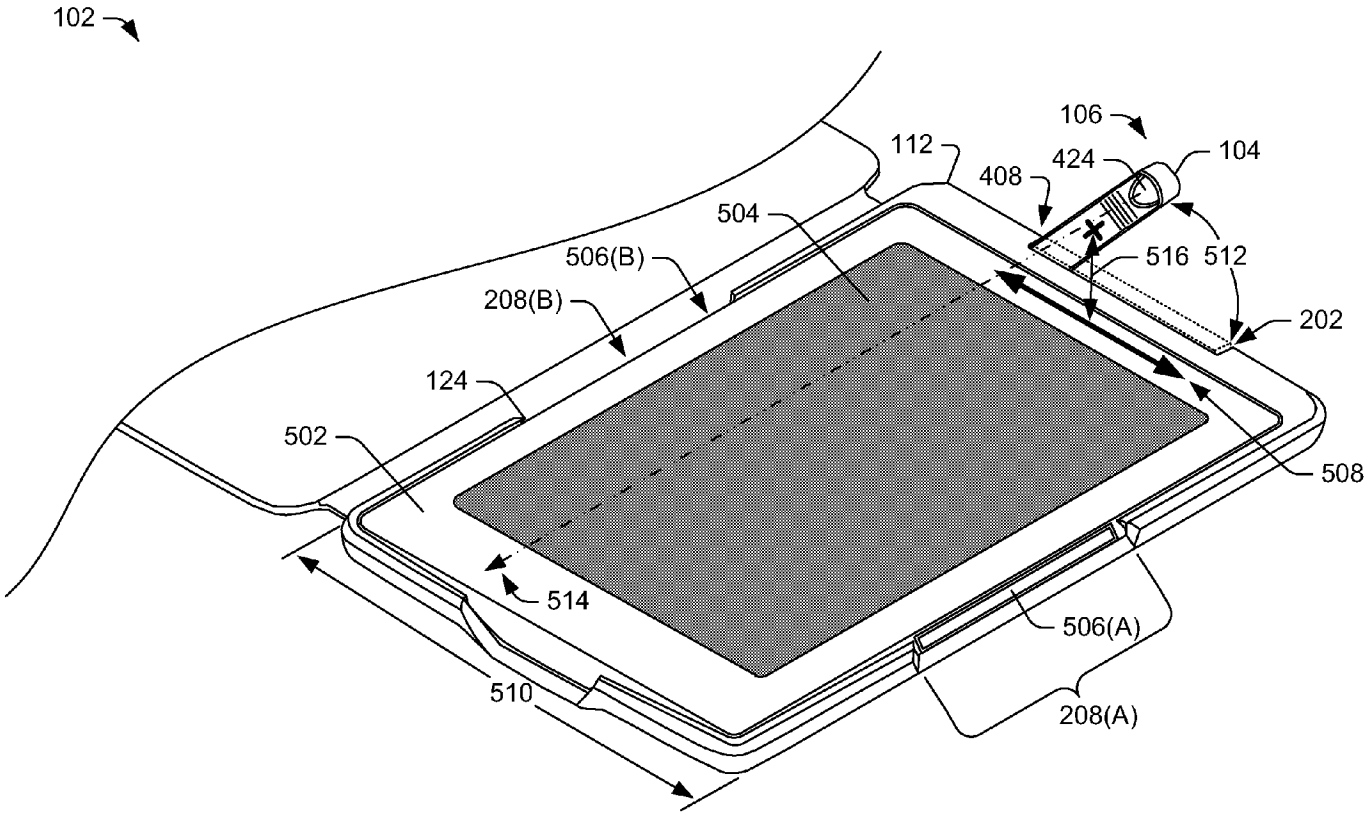
FIG. 5 illustrates the case of FIGS. 1 and 2 containing an electronic device.

FIG. 5 illustrates the case of FIGS. 1 and 2 containing an electronic device 502. The electronic device 502 may comprise a display 504 and one or more buttons 506(A) and 506(B). As discussed above, the side cutouts 208(A) and 208(B) may provide access to the buttons 506(A) and 506(B) of the electronic device 502 contained in the housing 112. The light arm 104 may be displaced in a horizontal direction 508 between the stowed position 202 and the use position 106 relative to a width 510 of the housing 112. In some implementations, the light arm 104 comprises a grip feature to assist a user in grasping the light arm 104 for displacing the light arm 104 between the stowed position 202 and the use position 106. The grip feature may comprise a structural element (e.g., a groove, a raised edge, a dent, or the like) or may comprise a material that having a higher static coefficient of friction than compared to surrounding material of the light arm 104. In either instance, the grip feature may enable a user to grasp the light arm 104 for deployment into or out of the use position.

The use position 106 of the light arm 104 may be a predefined degree 512 from the stowed position 202. For example, the use position 106 may be at least about 30 degrees to at most about 90 degrees from the stowed position 202 in some embodiments. When in the use position 106, the light 424 may be substantially centered at a middle 514 of the width 510 of the housing 112. Further, and when in the use position 106, the light arm 104 may be displaced a distance 516 perpendicular to a plane defined by the electronic device 502 (i.e., a distance 516 above the device in the "z" axis). For example, the light arm 104 may be displaced at least about 20 millimeters (0.8 inches) to at most about 25 millimeters (1 inch) perpendicular to the plane defined by the electronic device 502. Further, the light 424 may be inclined toward the electronic device 502. For example, the light arm 104 and/or the light 424 may comprise an inclination of about 15 degrees from a perpendicular orientation relative and towards the display 504 of the electronic device 502.

With the light 424 substantially centered at the middle 514 of the width 510 of the housing 112, the light 424 may provide even illumination of the electronic device 502 contained in the housing 112. For example, with the light 424 selectively displaced to an optimized use position (e.g., the illustrated use position 106), the pivotably attached light arm 104 effectively illuminates the display 504 of the electronic device 502 contained in the housing 112. For example, when the light arm 104 is in the use position 106, the light arm 104 reduces an amount of a glare light to a reader's eye while simultaneously increasing the uniformity of light distribution on the display 504 compared to existing deployable lights.

Figure 6:
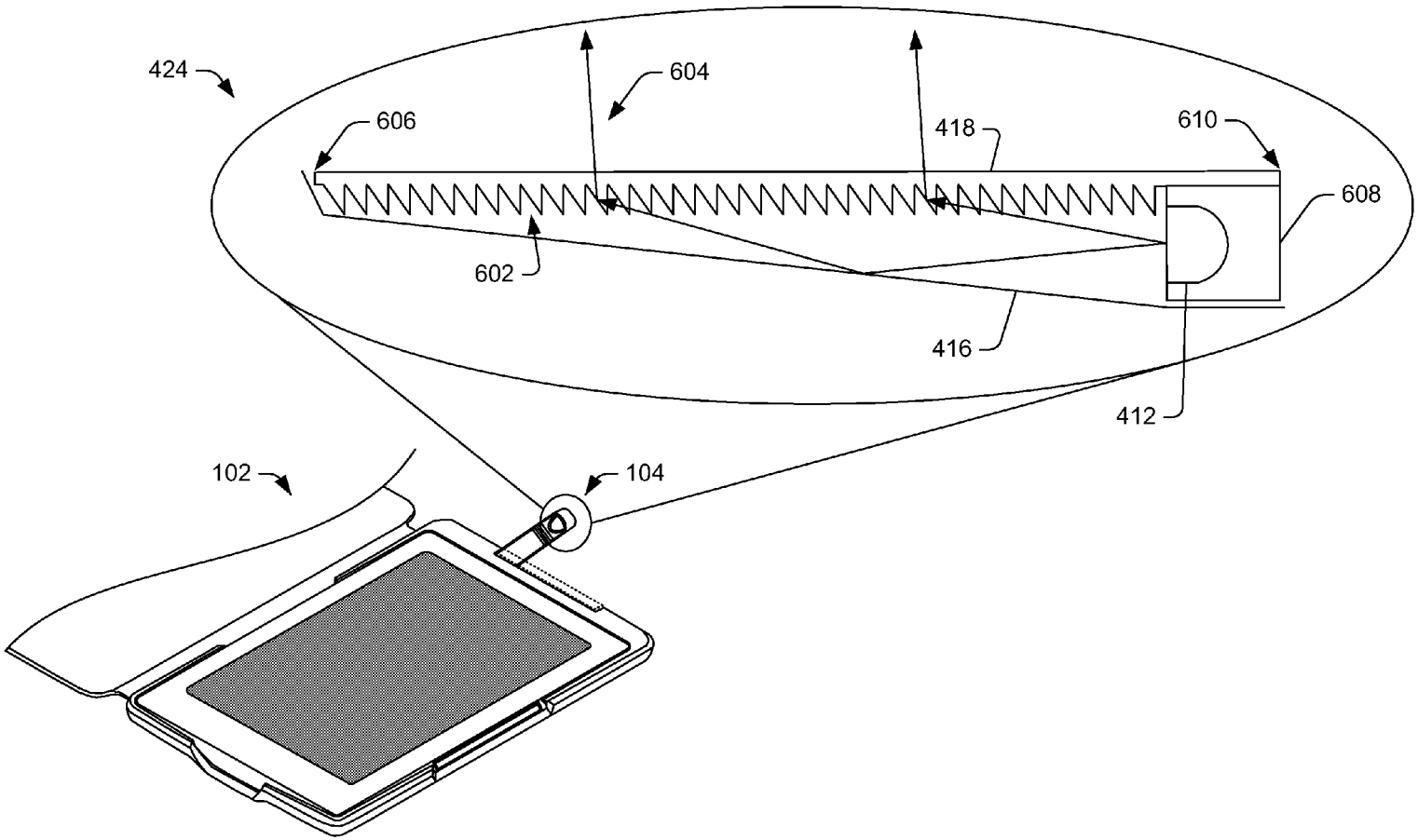
FIG. 6 illustrates a cross-sectional view of an example light of FIGS. 4 and 5 housed in a light arm.

FIG. 6 illustrates a cross-sectional view of an example light 424 of FIGS. 4 and 5 housed in a light arm 104. The lens 418 may comprise an ultra thin light-guide element with an optical surface relief structure 602 on one side of the surface for outcoupling light 604. The optical relief structure 602 may comprise any cross-sectional shape for outcoupling light from the lens 418. For example, the optical relief structure 602 may be a fine grating structure that includes an array of surface relief forms having any sort of cross-sectional shape (e.g., binary, blazed, slanted, sinusoidal, hybrid, etc.). The ultra thin lens 418 may comprise a substantially even thickness typically about 0.25 millimeters (0.01 inches) to about 0.4 millimeters (0.02 inches). As discussed above with respect to FIG. 4, the lens 418 may be formed of an optically clear polymeric material, elastomeric material, ceramic material, glass, or the like. For example, the lens 418 may be formed of a polyethylene terephthalate (PET), a poly(methyl methacrylate) (PMMA), polycarbonate (PC), or other polymers. The material may be clear ultraviolet (UV) or thermal cured. Several example configurations of lenses comprising an ultra thin light-guide element with an optical surface relief structure can be found in U.S. Pat. No. 7,563,011 and U.S. Pat. No. 7,565,054.

The reflector 416 may be arranged from the LED 412 to an edge 606 of the lens 418. The LED 412 may be housed by a bezel 608 disposed at another edge 610 of the lens 418, the other edge 610 opposite the edge 606. The reflector 416 may provide for reflecting light emitted from the LED 412 to the optical relief structure 602 of the lens 418.

Because the lens 418 may be an ultra thin light-guide element with an optical surface relief structure 602 on one side of the lens 418, the ultra thin lens 418 consumes less space than traditional light-guide elements. The thinner lens in turn enables the entirety of the light 424 to comprise a low-profile assembly. For example, because the ultra thin lens 418 consumes less space than traditional light-guide elements, the lens 418, LED 412, reflector 416, and window 422 may all be assembled in the first end 404 of the outer housing 402 of the light arm 104.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed is:

1. A case for holding an electronic device, the case comprising:

a housing comprising a base and a wall arranged around a perimeter of the base, the wall comprising an edge arranged around an inside of the wall defining a receptacle to removably receive the electronic device, the edge formed of a material more flexible than a material forming the base, at least a portion of the edge extending over a portion of the base to retain the electronic device in the receptacle;

a light arm pivotably attached to the wall to deploy from a stowed position to a use position, the light arm configured to shine light on the electronic device removably received in the receptacle when the light arm is in the use position;

a recess arranged in an outside of the wall opposite the edge to receive the light arm when the light arm is in the stowed position; and a cover pivotably attached to the housing to cover the electronic device removably received by the housing.

2. The case of claim 1, wherein:

the light arm comprises a pivot end and a light disposed distal to the pivot end;

the pivot end pivotably attaches proximate to a hinge pivotably attaching the cover to the housing; and when the light arm is in the use position the light is substantially centered at a middle of a width of the housing.

3. The case of claim 1, wherein:

the light arm comprises a pivot end and a light disposed distal to the pivot end; and the pivot end pivotably attaches proximate to a hinge pivotably attaching the cover to the housing.

4. A case for removably receiving an electronic device, the case comprising:

a housing comprising a base and a lip, the lip fixed above and extending over at least a portion of the base, the base and the lip defining a receptacle to removably receive the electronic device, and the lip to retain the electronic device in the receptacle; and a light arm pivotably attached to an outside of a wall of the housing to deploy from a stowed position to a use position, the light arm being substantially flush with the outside of the wall of the housing when in the stowed position and illuminating the electronic device removably received in the receptacle when pivoted into the use position.

5. The case of claim 4, wherein the lip is over-molded to the base.

6. The case of claim 4, wherein the lip is formed of a material that is more flexible than a material forming the base.

7. The case of claim 6, wherein the lip is formed of a thermoplastic polyurethane or a thermoplastic rubber.

8. The case of claim 6, wherein the base is formed of a polycarbonate acrylonitrile butadiene styrene or a polycarbonate.

9. The case of claim 4, further comprising a cavity arranged in the base to provide a passage way for sound produced by a speaker of the electronic device removably received in the receptacle.

10. The case of claim 4, further comprising first and second cavities arranged in the base and separated from one another by a ridge, the first and second cavities each providing a respective passage way for sound produced by a respective speaker of the electronic device removably received in the receptacle, and the ridge to keep separate the sounds produced by the respective speakers of the electronic device.

11. The case of claim 4, further comprising a recess arranged in a top portion of the housing, the recess to receive the light arm in the stowed position.

12. The case of claim 4, further comprising a side cutout arranged in a side of the housing, the side cutout to provide access to a button of the electronic device removably received in the receptacle.

13. A housing for receiving an electronic device, the housing comprising:

a wall arranged around a perimeter of the housing, the wall comprising a lip arranged on an inside of the wall opposite an outside of the wall and defining a receptacle, the lip extending over at least a portion of a base of the receptacle to retain the electronic device in the receptacle;

a light arm comprising a fulcrum on a first end and a light on a second end that is distal to the first end; and a recess arranged to receive the light arm when the light arm is in a stowed position, the recess comprising a cooperating pocket to pivotably couple with the first end of the light arm, the fulcrum and the cooperating pocket providing for selectively pivoting the light arm between the stowed position and a use position.

14. The housing of claim 13, wherein the light arm is displaced horizontally between the stowed position and the use position relative to a width of the housing.

15. The housing of claim 13, wherein the housing defines a plane and the light arm is displaced at least about 15 millimeters to at most about 30 millimeters perpendicular to the plane defined by the housing when the light arm is in the use position.

16. The housing of claim 13, wherein the second end of the light arm pivots about the first end when the light arm is deployed from the stowed position to the use position, the second end pivoting approximately between 30 degrees and 90 degrees when deploying to the use position from the stowed position.

17. The housing of claim 13, wherein in the use position the light is substantially centered at a middle of a width of the housing to provide substantially even illumination on the electronic device received in the housing.

18. The housing of claim 13, wherein the light is recessed behind a visor arranged in the light arm, the visor to direct light emitted from the light toward the electronic device received in the housing to substantially prevent the emitted light from shining in a user's eye when the light arm is in the use position.

19. The housing of claim 13, wherein the light comprises a lens having an edge, the edge to receive light from an LED.

20. The housing of claim 19, wherein the lens is formed of an optically clear polyethylene terephthalate.

21. The housing of claim 13, wherein:

the light comprises a lens having an optical surface relief structure, the optical surface relief structure to receive light from an LED and diffract the light towards the receptacle.

22. The housing of claim 13, wherein the cooperating pocket comprises a stop surface to prevent the light arm from being pivoted past the use position.

* * * * *